United States Patent [19]

Kemp, Jr. et al.

[11] Patent Number: 4,844,355

[45] Date of Patent: Jul. 4, 1989

[54] APPARATUS FOR MILLING METAL POWDER TO PRODUCE HIGH BULK DENSITY FINE METAL POWDERS

[75] Inventors: Preston B. Kemp, Jr., Athens; Robert J. Holland, Sr., Sayre, both of Pa.

[73] Assignee: GTE Products Corporation, Stamford, Conn.

[21] Appl. No.: 117,702

[22] Filed: Nov. 5, 1987

[51] Int. Cl.[4] ..... B02C 17/16

[52] U.S. Cl. ..... 241/172; 366/279; 366/343

[58] Field of Search ..... 241/172, 199.7, 199.12, 241/277; 366/279, 343

[56] References Cited

U.S. PATENT DOCUMENTS

| | | | |
|---|---|---|---|
| 132,483 | 10/1872 | Muth | 366/343 |
| 2,179,271 | 11/1939 | Pick | 366/343 |
| 3,131,875 | 5/1964 | Szegvari | 241/172 X |
| 3,450,356 | 6/1969 | Szegvari | 241/172 |

FOREIGN PATENT DOCUMENTS

| | | | |
|---|---|---|---|
| 207661 | 3/1984 | Fed. Rep. of Germany | 366/343 |
| 1014584 | 4/1983 | U.S.S.R. | 241/172 |

*Primary Examiner*—Joseph M. Gorski

*Attorney, Agent, or Firm*—Donald R. Castle; L. Rita Quatrini

[57] ABSTRACT

Apparatus for milling metal powder in a mill is disclosed which comprises a central shaft, the top of which is rotatably mounted to rotating apparatus, bottom stirrer(s), attached to the bottom edge of central shaft, upper stirrer(s), attached above the point of attachment of the bottom stirrer(s), and two or more primary stirrers, upper ends of which are attached to outer edge(s) of the upper stirrer(s) and the bottom ends attached to bottom edge(s) of the bottom stirrer(s). The bottom stirrer has a downward sloping leading edge with a first angle formed by a first plane extending along this edge to a second plane extending along the bottom of the mill, this angle being 10° to 90°, the first angle being that between those faces of the first and second planes within which the bottom stirrer sits. The distance between the bottom of the mill and the lowest point of the downward sloping leading edge is equal to or less than the distance between the bottom of the mill and the other points on the bottom edge of the bottom stirrer. The upper stirrer has an upward sloping leading edge, with a second angle formed by a third plane extending along this edge to a fourth plane parallel to the top of the mill and above the upper stirrer(s), this angle being 10° to 90°, the second angle being that between those faces of the third and fourth planes within which the upper stirrer sits. The distance between the fourth plane and the uppermost point of the upward sloping leading edge is equal to or less than the distance between the fourth plane and the other point(s) on the top edge of the upper stirrer(s).

8 Claims, 10 Drawing Sheets

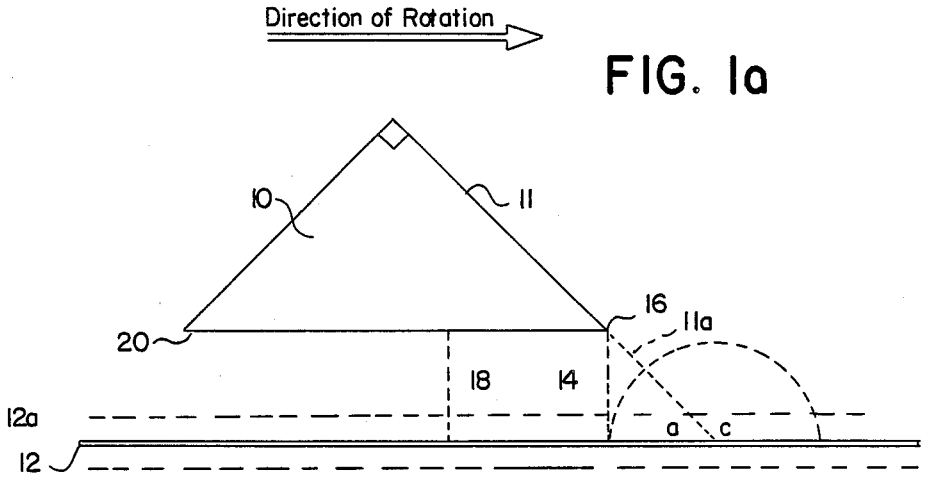
FIG. 1a
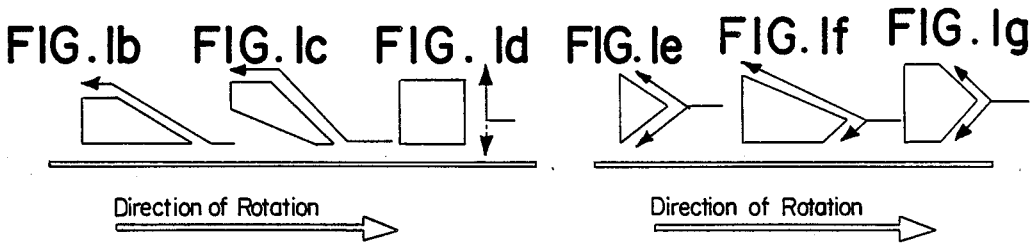

FIG. 2a
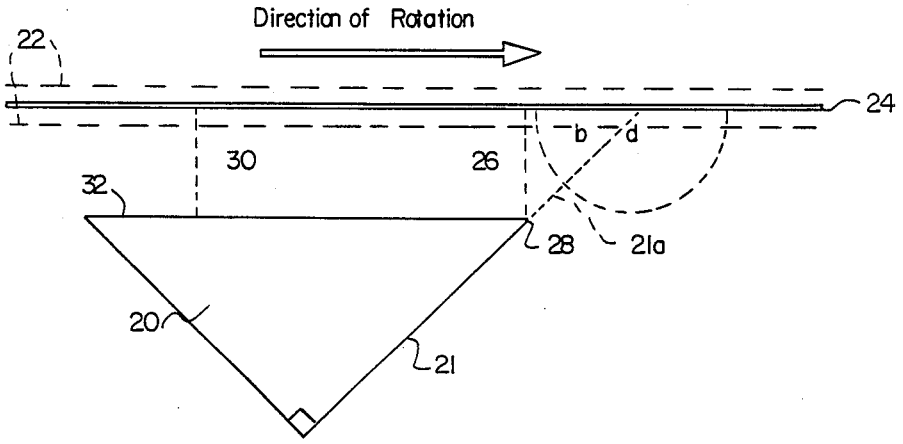
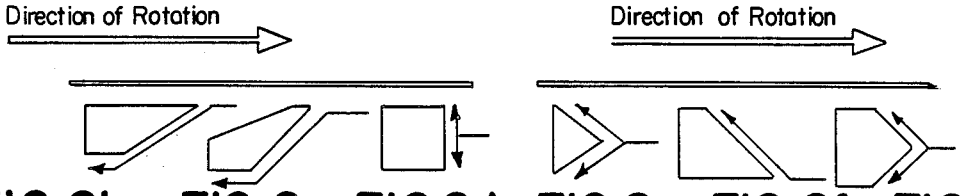
FIG. 2b FIG. 2c FIG. 2d FIG. 2e FIG. 2f FIG. 2g

FIG. 6a
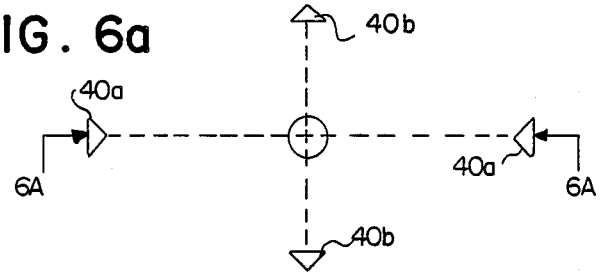
FIG. 6d
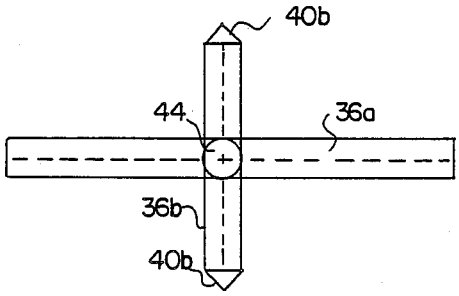
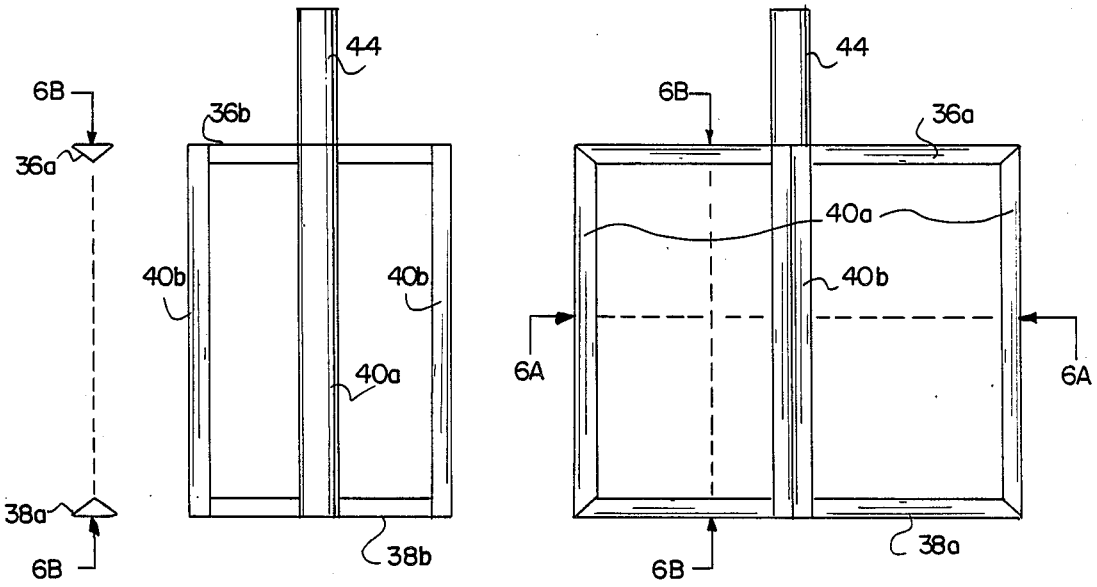
FIG. 6b FIG. 6c FIG. 6

FIG. 9a
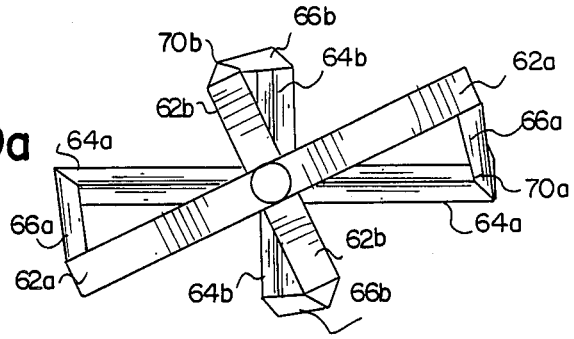
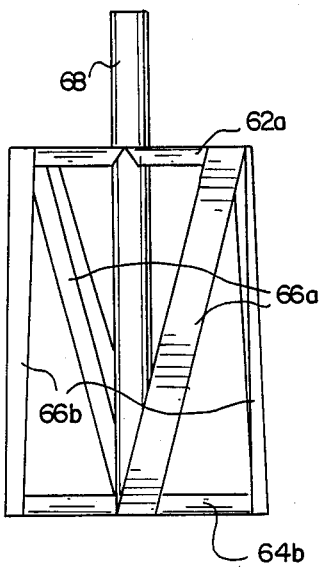
FIG. 9b
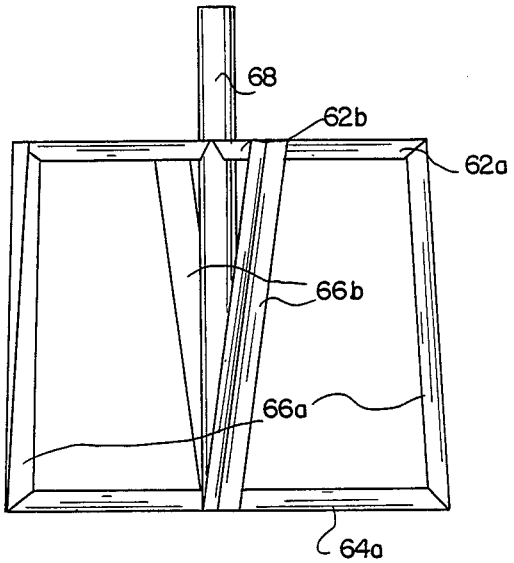
FIG. 9c

APPARATUS FOR MILLING METAL POWDER TO PRODUCE HIGH BULK DENSITY FINE METAL POWDERS

This invention relates to an apparatus for milling metal powder to produce high density fine metal powders which makes use of a novel design of agitators for a stirred media mill. More particularly the agitator design allows a high media packaging density to be maintained so that size reduction of the metal powder is accomplished by shearing and attrition rather than impact.

BACKGROUND OF THE INVENTION

Mechanically reducing the size of ductile metal powders using conventional stirred ball mills yields a product which is typically "flaky" in morphology. This is due to a great extent to the design of the milling media agitators, which are generally constructed in such a way that the media is vigorously lifted up while being stirred. This leads to a lower than desired media packing density, extensive media-media impact, and a "flaky" final product.

Previous efforts in fine grinding of ductile metal powders fall into two categories: (1) metal flake production for coatings and paints, and (2) mechanical alloying.

The former is a very straightforward process. Metal powders are processed in either a rotary (tumbling) ball mill or a stirred ball mill as slurry with either water or an organic solvent. Usually the slurry has additions of an organic compound which adsorbs on newly exposed powder surfaces and reduces or prevents welding or agglomeration of the particles. Impact is maximized by the selection of milling parameters, and the resulting product has a very thin "flaky" morphology (i.e. diameter: thicknesss ratios >20–50.) This is desirable for this application, since one intent of the product is to produce a coating consisting of overlapping thin flakes of metal bound together by an organic resin or polymer.

In mechanical alloying, metal powders, with or without additions of metallic oxides, are processed for very long times to achieve mixing of the components on an atomic scale. True alloys (as measured by x-ray diffraction) may be produced from elemental components by using this process. Component powders are processed dry in either a rotary ball mill or a stirred ball mill. Again conditions are chosen so that maximal impact occurs. The particles typically flatten to a flaky morphology, are mechanically welded or forged back together into agglomerates, and the agglomerates are broken down in size. This three step action of mechanical work, agglomeration, and fracture eventually yields roughly equiaxed particles. However, processing times are long to achieve an equilibrium state and there is always the risk of overheating the powder and welding the media and powder into a solid mass. The long processing times required for mechanical alloying are not necessary nor are they desirable for size reduction of pre-alloyed metal powders. The production rate can be shortened extensively by not processing to an equilibrium state, as long as the particles develop and maintain a roughly equiaxed morphology.

SUMMARY OF THE INVENTION

In accordance with one aspect of this invention, there is provided an apparatus for milling metal powder in a stirred media mill which comprises a central shaft the top of which is rotatably mounted to rotating means, at least one bottom stirrer, attached to the bottom edge of the central shaft, at least one upper stirrer, attached above the point of attachment of the bottom stirrer, and two or more primary stirrers, the upper ends of which are attached at or near the outer edge of an upper stirrer and the bottom ends attached at or near the bottom edge of a bottom stirrer, with the edges being those that are closest to one another. The bottom stirrer has a downward sloping leading edge with a first angle formed by a first plane extending along this edge to a second plane extending along the bottom of the mill and the second plane being 10° to 90°, with this angle being that which is between those faces of the first and second plane within which the bottom stirrer sits. The distance between the bottom of the mill and the lowest point of the downward sloping leading edge is equal to or less than the distance between the bottom of the mill and any other point on the bottom edge of the bottom stirrer. The upper stirrer has an upward sloping leading edge, with a second angle formed by a third plane extending along this edge to a fourth plane parallel to the top of the mill and above the upper stirrer and the fourth plane being 10° to 90°, the second angle being that which is between those faces of the third and fourth plane within which the upper stirrer sits. The distance between the fourth plane and the uppermost point of the upward sloping leading edge is equal to or less than the distance between the fourth plane and any other point on the top edge of the upper stirrer.

BRIEF DESCRIPTION OF THE FIGURES

FIGS. 1*a*, 1*b*, 1*c*, and 1*d* show cross sections of some acceptable basic designs of the bottom stirrers.

FIGS. 1*e*, 1*f*, and 1*g* show cross sections of some basic designs of the bottom stirrers which are not acceptable to the practice of the present invention.

FIGS. 2*a*, 2*b*, 2*c*, and 2*d* show cross sections of some acceptable basic designs of the upper stirrers.

FIGS. 2*e*, 2*f*, and 2*g* show cross sections of some basic designs of the upper stirrers which are not acceptable to the practice of the present invention.

FIG. 6 is a front view of the apparatus of FIG. 5.

FIG. 6*a* shows a cross section of the apparatus of FIG. 3 through a plane perpendicular to the central shaft.

FIG. 6*b* shows a cross section of the apparatus of FIG. 5 through a plane parallel to the central shaft and perpendicular to the longer upper and bottom stirrers.

FIG. 6c is a side view of the apparatus of FIG. 5.

FIG. 6d is a top view of the apparatus of FIG. 5.

FIGS. 9a, 9b, and 9c are top, side and front views of the apparatus of FIG. 8.

DETAILED DESCRIPTION OF THE INVENTION

Figure 3:
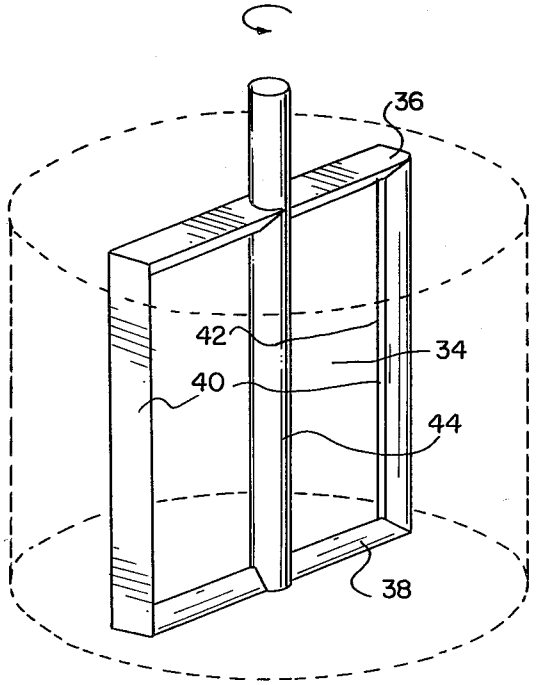
FIG. 3 is a perspective view of one aspect of the invention showing one upper and one bottom stirrer which are coplanar and two primary stirrers which are in the shape of triangular prisms.

For a better understanding of the present invention, together with other and further objects, advantages and capabilities thereof, reference is made to the following disclosure and appended claims in connection with the above described drawings and description of some of the aspects of the invention.

The primary goal of the apparatus of the present invention is to achieve a high density state of the milling media and powder in a stirred media mill. The powders that are especially suited to this invention are metal powders, especially ductile metal powders.

The secondary goal is to reduce compression and wedging of the milling media and powder between the bottom stirrer and the bottom of the mill. When milling media balls are trapped beneath the agitator, the shaft is jarred causing excessive stress on the agitator shaft bearings and the media suffers high compressive loading, causing breakage. This undesirable trapping can be prevented by using one or more horizontal stirring bars at the bottom of the mill sweeping essentially most of the area of the mill bottom, having a flat or downward sloping (toward the direction of rotation) leading edge which tends to lift the media upwards, thus reducing the trapping of the media beneath the stirrer. Although on the surface, the invention appears to be contrary to achieving a high density state, the lifting of the media by the bottom stirrer is of much less consequence than media lifting by stirring members near the top of the mill, because there is enough weight of media pressing down on the media at or near the bottom of the mill to prevent the lower packing density state from occuring.

The present invention offers many advantages over conventional stirred media milling equipment for the mechanical size reduction of metal powders. The powders so produced are ideal feedstocks for plasma melting, the end product of which is a fine spherical metal powder.

The design of the present invention allows the primary goal of a high packing density to be realized. This is done by vigorously stirring the media with as little decrease in packing density as possible compared to the media packing density when at rest to effect size reduction of ductile metal powders. A high media packing density implies that the mean free path of the individual media (most typically balls) is short. Therefore, impact between balls is reduced compared to a lower density state and most of the mechanical size reduction takes place by shear either between the media balls or between powder particles. The particles which are the product of this invention are of relatively high apparent density and are typically less than about 20 micrometers in mean particle size.

The agitator designs of the present invention allow the milling media to be stirred without being significantly lifted. This allows the production of high apparent density fine metal powder, which has generally a granular, equiaxed morphology.

Overall Description of the Apparatus

The apparatus of the present invention is an agitator for a stirred media mill. It comprises a central shaft the top of which is rotatably mounted to rotating means. There is at least one bottom stirrer, at least one upper stirrer, and two or more primary stirrers. The bottom stirrer or stirrers are attached to the bottom end of the central shaft. The upper stirrer or stirrers are attached at points above the point of attachment of the bottom stirrer.

The Bottom Stirrer(s)

The bottom stirrer(s) has a downward sloping leading edge, with a first angle formed by a first plane extending along the downward sloping leading edge to a second plane extending along the bottom of the mill and the second plane being from about 10° to about 90°. The first angle is preferably from about 10° to about 45° with 45° being especially preferred because a stirrer with this angle is easy to make. For example it can be made by cutting a bar of desired material with a square cross section in half along the diagonal. The first angle must be that angle which is between the faces of the first and second planes within which the stirrer sits. This angle will be shown in the Figures that follow. Another important feature of the bottom stirrer(s) is that it (or they) have a bottom edge with the arrangement and design being that distance between the bottom of the mill and the lowest point of the downward sloping leading edge be equal to or less than the distance between the bottom of the mill and any other point on the bottom edge of the bottom stirrer.

The Upper Stirrer(s)

The upper stirrer(s) has an upward sloping leading edge, with a second angle formed by a third plane extending along the upward sloping leading edge to a fourth plane parallel to the top of the mill and above the uppermost upper stirrer and plane four being from about 10° to about 90°. The second angle is preferably from about 10° to about 45° with 45° being especially preferred for the reason given above. Also, this angle is the upper stirrers affords the additional and more important advantage of more adequately forcing the media downwards therefore insuring a high density state. The second angle must be that angle which is between the faces of the third and fourth planes within which the upper stirrer sits. This angle will be shown in the Figures that follow. Another important feature of the upper stirrer(s) is that it (or they) have a top edge with the arrangement and design being that distance between the top of the mill and the uppermost point of the upward sloping leading edge (the fourth plane) be equal to or less than the distance between plane four and any other point on the top edge of the upper stirrer.

The Primary Stirrers

Each of the primary stirrers has its top end attached at or near the outer edge of an upper stirrer and its bottom end attached at or near the outer edge of a bottom stirrer, with the edges being those which are closest to one another. The shape of the primary stirrers can be any shape such as cylindrical, rhomboidal, or triangular, etc. in cross section. The latter shape, more specifically right isosceles triangles in cross-section is a very typical shape because they are easy to manufacture.

The Central Shaft

The central shaft can be attached to rotating means which can be any means such as a motor, by any standard method. One method is by variable frequency controlled AC motors or variable speed drives.

Conventional agitators have horizontal round stirrers radiating from the central shaft. This arrangement results in a low media packing density which results in a long mean free path for the media which causes milling by impact. While horizontal bars are ideal for grinding hard and/or brittle materials, this is not an appropriate design for the mechanical size reduction of ductile metal powders. This invention incorporates upper and bottom bars or stirrers which can be thought of in a broad sense as "horizontal stirrers for all practical purposes" for three functions only: (1) bottom stirrers to ensure adequate mixing towards the bottom of the milling vessel and (2) both upper and bottom stirrers for structural support of the primary agitating members, and (3) the upper stirrers for compression of the media. The upper and bottom stirrers of this invention can be thought of as "horizontal for all practical purposes. By "horizontal" is meant that an imaginary line passing through the center of mass of the stirrer is perpendicular to the central shaft and parallel to the bottom of the mill. When horizontal stirring bars are incorporated into the agitator design, they are always shaped so as to minimize deleterious effects on the movement of the milling media.

Referring now to the drawings, FIGS. 1*a*, 1*b*, 1*c* and 1*d* show cross sections of some acceptable designs of the bottom stirrers. FIG. 1*a* shows bottom stirrer (10) in the shape of a right isosceles triangle in cross section with the the downward sloping leading edge (11) and first plane indicated by imaginary line (11*a*) extending along this edge intersecting second plane (12*a*) extending along the the bottom of the mill (12) to form an first angle, a, 45°. In FIG. 1*a* it can be seen that first angle a is between the faces of the first and second planes within which stirrer (10) sits, as opposed to angle c, its supplementary angle which is between the faces of the first and second planes outside of which the stirrer sits. Angle c therefore not the angle with which the present invention is concerned and is illustrated here only to clarify the position of angle a. In the design of FIG. 1*a* the distance (14) between the second plane (12A) and the lowest point (16) of the downward sloping leading edge is equal to the distance (18) between the second plane (12A) and any point on the bottom edge (20) of the stirrer. In FIG. 1*b*, angle a is <45° and distances (14) and (18) are the same as in FIG. 1*a*. In FIG. 1*c*, angle a is 45° and distance (14) is less than or equal to distance(s) (18). In FIG. 1*d*, angle a is 90° and distance (14) is equal to distance(s) (18). These designs allow the bottom stirrer(s) to force media and powder upwards and to prevent the media from "crunching" underneath the stirrer. In the prior art design of cylindrical cross section bars, the media and powder are compressed under the stirrer causing trapping and breaking of the media and stress on the agitator shaft bearings. If one were to raise the stirrer to prevent trapping of the media, a so called "dead zone" of media and powder is created between the bottom of the mill and the bottom of the lowest stirrer. This dead zone is not adequately stirred with the prior art stirrer designs. The new design of the horizontal stirrers of this invention avoids this dead zone of powder by allowing the bottom stirrer to be operated closer to the bottom of the mill than the prior art. FIGS. 1*e*, 1*f*, and 1*g* show cross sections of unacceptable designs of bottom stirrers. In FIGS. 1*e*, 1*f*, and 1*g* distance (14) is greater than distance (18). The designs illustrated in FIGS. 1*e*, 1*f*, and 1*g* result in the milling media being compressed under the bottom stirrer. This is an undesirable state because the media and powder are compressed under the stirrer causing trapping and breaking of the media and stress on the agitator shaft bearings.

FIGS. 2*a*, 2*b*, 2*c*, and 2*d* show cross sections of acceptable designs for the upper stirrers. FIG. 2*a* shows upper stirrer (20) in the shape of a right isosceles triangle in cross section with the upward sloping leading edge (21) and third plane indicated by imaginary line (21*a*) extending along this edge intersecting fourth plane (22) parallel to the top (24) of the mill to form an angle, b, of 45°. In FIG. 2*a* it can be seen that second angle b is between the faces of the third and fourth planes within which stirrer (20) sits, as opposed to angle d, its supplementary angle which is between the faces of the third and fourth planes outside of which the stirrer sits. Angle d therefore not the angle with which the present invention is concerned and is illustrated here only to clarify the position of angle b. In the design of FIG. 2*a* the distance (26) between the fourth plane (22) and the uppermost point (28) of the upward sloping leading edge is equal to the distance (30) between the top of the mill and and any other point on the top edge (32) of the stirrer. In FIG. 2*b*, angle b is =45° and distances (26) and (30) are the same as in FIG. 2*a*. In FIG. 2*c*, angle b is 45° and distance (26) is less than or equal to distance(s) (30). In FIG. 2*d*, angle b is 90° and distance (26) is equal to distance (30). In designs 2*a*, 2*b*, and 2*c*, angle b is between 10° and 45°, which is the preferred range for the angle because with these designs the media is forced downwards. In the design of 2*d*, angle b is 90°. The design of 2*d* reduces lifting of the media as compared to prior art stirrers, but it is not the preferred design because it does not force the media downwards. The prior art cylindrical cross section stirrers cause the media to be directed both upwards and downwards promoting the undesirable low density state in the media. FIGS. 2*e*, 2*f*, and 2*g* show cross sections of unacceptable designs of upper stirrers. In FIGS. 2*a*, 2*f*, and 2*g*, distance 26 is greater than distance (30). The designs illustrated in FIGS. 2*e*, 2*f*, and 2*g* result in the milling media to be forced upward resulting in a low density state. This is an undesirable state because it leads to a lower than desired packing density, extensive media-media impact, and a "flaky" final product.

As a result of the action of the upper stirrer(s) the media is in a high density state and milling its accomplished by attrition and not by impact.

A confirmation of the design of the upper horizontal stirrer(s) is that after start-up of the mill, there is less media volume increase which contributes favorably to the high density state.

In actuality there can be any number of bottom and upper stirrers. However, the usual number is one or two bottom and one or two upper stirrers. Two bottom and two upper stirrers are the preferred numbers.

The primary stirrers allow vigorous stirring of the milling media while simultaneously maintaining a high packing density state in the milling media. These primary stirrers are the primary means by which energy is introduced into the mill in order to mechanically reduce the size of the powder. They do not impart any upward vertical motion to the media, except for the "piling" up which occurs in front of the bars as they sweep through the media.

There are at least two primary stirrers. Each of the primary stirrers has its top end attached at or near the outer edge of a upper stirrer and its bottom end attached at or near the outer edge of a bottom stirrer, with the respective top and bottom edges being those that are closest to one another. When the upper and bottom stirrers are coplanar, the primary stirrers are vertical or perpendicular to the upper and bottom stirrers and parallel to the central shaft. When the upper and bottom stirrers are non-coplanar, the primary stirrers are not vertical but are slanted making an angle of usually of up to about 45° with the central shaft.

Figure 4A:
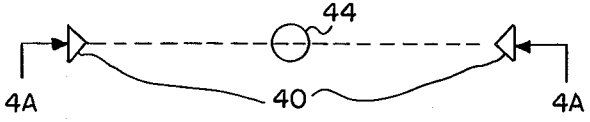
FIG. 4*a*, shows a cross section of the apparatus of FIG. 3 through a plane perpendicular to the central shaft.
Figure 4D:
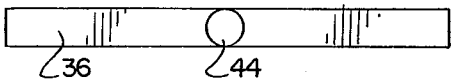
FIG. 4*d* is a top view of the apparatus of FIG. 3.
Figure 4:
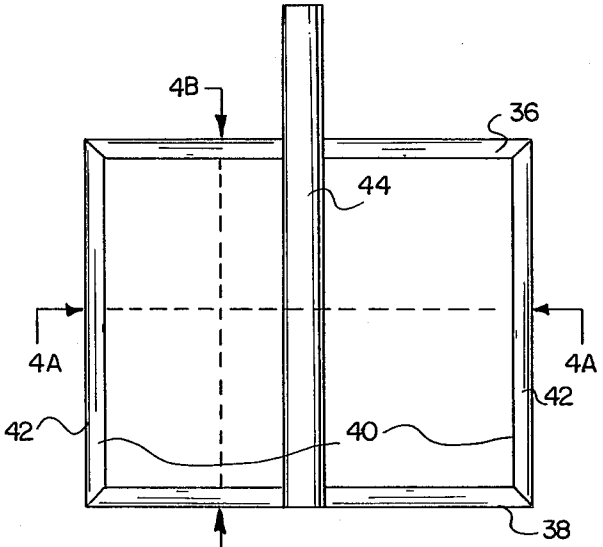
FIG. 4 is a front view of the apparatus of FIG. 3.
Figure 4C:
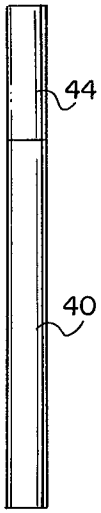
FIG. 4*c* is a side view of the apparatus of FIG. 3.
Figure 4B:
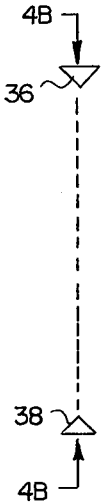
FIG. 4*b* shows a cross section of the apparatus of FIG. 3 through a plane parallel to the central shaft and perpendicular to the upper and bottom stirrers.

FIG. 3 is a perspective view of one apparatus (34) of the invention showing one upper (36) and one bottom stirrer (38) which are coplanar and two primary stirrers (40) which are in the shape of triangular prisms with apex edge (42). Because the upper and bottom stirrers are coplanar, the primary stirrers are parallel to the central shaft (44). FIG. 4 is a front view of the apparatus of FIG. 3 showing the relationships of the various parts. FIG. 4*a* shows a cross section of the apparatus of FIG. 3 through a plane (4A) perpendicular to the central shaft. In this view the cross section of the triangular prism primary stirrers is seen. FIG. 4*b* shows a cross section of the apparatus of FIG. 3 through a plane (4B) parallel to the central shaft and perpendicular to the upper and bottom stirrers. The shape of the upper and bottom stirrers is shown here. The bottom stirrer (38) has the shape of the stirrer in FIG. 1*a*. The upper stirrer (36) has the shape of the stirrer in FIG. 2*a*. FIG. 4*c* is a side view of the apparatus of FIG. 3 showing primary stirrers (40) and the central shaft (44). FIG. 4*d* is a top view of the apparatus of FIG. 3 showing the upper stirrer (36) and the central shaft (44).

Figure 5:
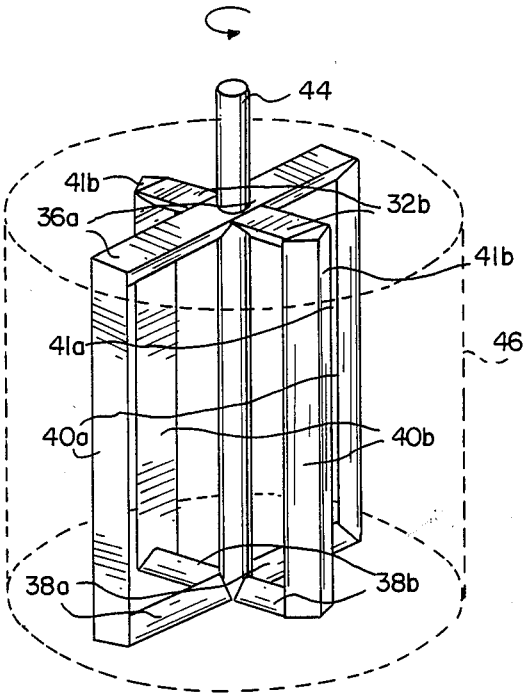
FIG. 5 is a perspective view showing an aspect of this invention in which there are two upper stirrers, one longer and one shorter, two bottom stirrers, one longer and one shorter, and four primary stirrers with the longer upper and bottom stirrers being coplanar, and the shorter upper and bottom stirrers being coplanar.

FIG. 5 is a perspective view showing an apparatus (46) of this invention in which there are two upper stirrers (36), two bottom stirrers (38), and four primary stirrers (40) with long upper and bottom and short upper and bottom pairs of stirrers being coplanar.

When there are more than two primary stirrers, the preferred arrangement is to have the upper and bottom stirrers to which they are attached be of different lengths. For example, one set of upper and bottom stirrers has a length that allows them to approach the lateral edges of the mill without touching these lateral edges, and the other set of upper and bottom stirrers has a length which is shorter than the length of the first set of stirrers. FIG. 5 shows such an arrangement with upper stirrer (36*a*) and bottom stirrer (38*a*) being the longer set and upper stirrer (36*b*) and bottom stirrer (38*b*) being the shorter set. Primary stirrers (40*a*) and primary stirrers (40*b*) are attached to the outer edges of the respective lettered upper and bottom stirrers. The primary stirrers shown in FIG. 5 are in the shape of triangular prisms. In the case of triangular prisms attached to upper and bottom stirrer sets of unequal length, the apex edge of the primary stirrers which are attached to the longer set of upper and bottom stirrers is directed radially inward with respect to the central shaft. And the apex edge of the primary stirrers which are attached to the shorter set of upper and bottom stirrers is directed radially outward with respect to the central shaft. The apex of the primary stirrers is directed radially outward if the length of the upper and bottom stirrers to which the primary stirrers is attached is no longer than about one-half the radius of a circle formed by the rotation of the longest upper or bottom stirrer. FIG. 5 primary stirrers (40*a*) attached to the longer upper and bottoms stirrers, (36*a*) and (38*a*) respectively have their apex edges (41*a*) directed radially inwards with respect to central shaft (44). Primary stirrers (40*b*) attached to the shorter upper and bottom stirrers (36*b*) and (38*b*) respectively have their apex edges (41*b*) directed radially outward with respect to the central shaft. The advantage of having the apexes of the prisms pointing inward and outward as described above is that there is more thorough agitation of the milling charge, that is, the milling media and powder than in prior art arrangements. FIG. 6 is a front view of the apparatus of FIG. 5 showing the relationships of the various parts. FIG. 6*a* shows a cross section of the apparatus of FIG. 5 through a plane (6A) perpendicular to the central shaft. In this view the cross section of the triangular prism primary stirrers is seen (40*a* and 40*b*). FIG. 6*b* shows a cross section of the apparatus of FIG. 5 through a plane (6B) parallel to the central shaft and perpendicular to the longer upper and bottom stirrers, 36A and 38A respectively. The shape of the upper and bottom stirrers is shown here. The bottom stirrer (38*a*) has the shape of the stirrer in FIG. 1*a*. The upper stirrer (36*a*) has the shape of the stirrer in FIG. 2*a*. FIG. 6*c* is a side view of the apparatus of FIG. 5. FIG. 6*d* is a top view of the apparatus of FIG. 5 where the shape of the upper stirrers and the outer edges of the primary stirrers (40*b*) are shown.

The preferred arrangement of horizontal bars is non-coplanar so that the primary stirrers are slanted. The primary stirrers are tangential to a circle concentric with the central shaft, expressed in another way, the primary stirrers are sloped tangentially upwards toward the direction of rotation. The slanted primary stirrers result downward motion of the media as opposed to truly vertical primary stirrers which cause some undesirable upward motion of the media.

The most preferred aspect of the present invention is to have the horizontal bars non-coplanar and the primary stirrers in the shape of right isosceles triangular prisms. The advantage of this design in addition being easy to manufacture is that it results in maximum effect of achieving the high density state in the mill.

Figure 7C:
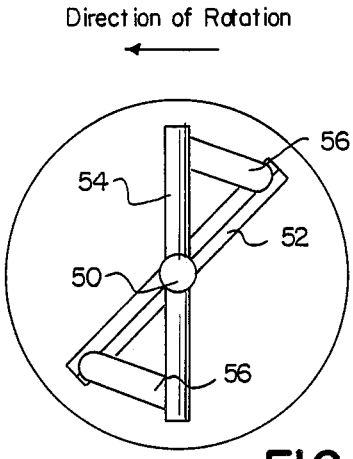
FIGS. 7a, 7b, and 7c show front, side, and top views respectively of one upper stirrer and one bottom stirrer which are not coplanar and two primary stirrers.
Figure 7A:
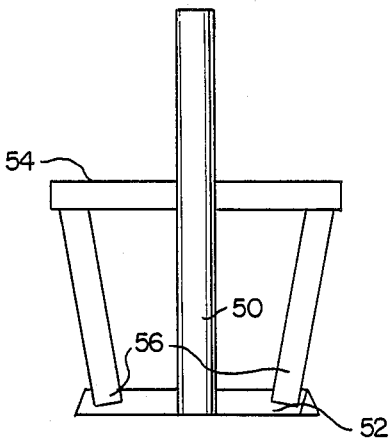
Figure 7B:
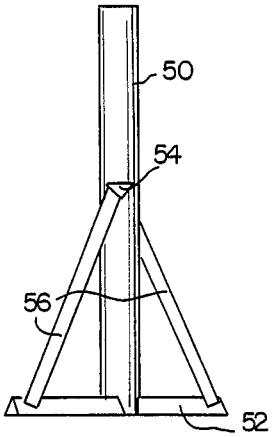

FIGS. 7*a*, 7*b*, and 7*c* show front, side and top views respectively of upper stirrers (54), bottom stirrers (52) which are not coplanar and the primary stirrers (56), and central shaft (50). The upper and bottom stirrers (54) and (52) respectively are in different planes and therefore primary stirrers (56) are slanted.

Figure 8:
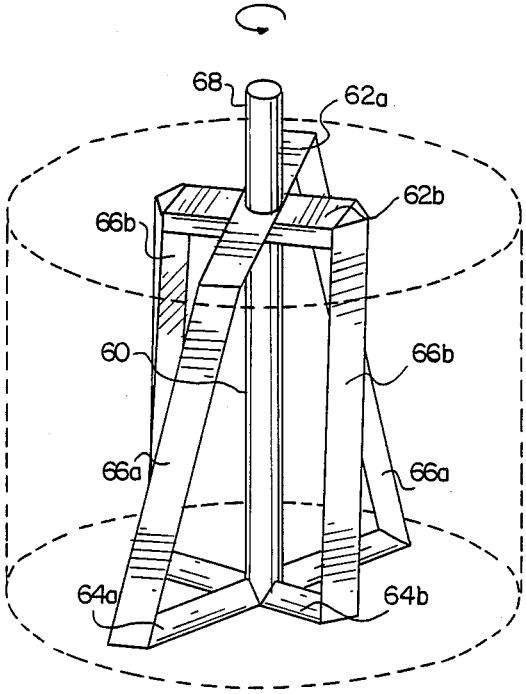
FIG. 8 is a perspective view of non-coplanar upper and bottom stirrers, two each, with four primary stirrers.

FIG. 8 is a perspective view of an apparatus (60) of the present invention having non-coplanar upper stirrers, (62*a*) longer, and (62*b*) shorter, and bottom stirrers, (64*a*) longer and (64*b*), shorter, and primary stirrers 66*a*, two in number, and 66*b*, two in number attached to the respective lettered upper and bottom stirrers, and central shaft (68). FIGS. 9*a*, 9*b*, and 9*c* are top, side, and front views of the apparatus of FIG. 8 showing the respective parts. In FIG. 9*a*, the apex edges (70*a*) of the longer primary stirrers (66*a*) are shown directed radially inwards with respect to the central shaft and the apex edges (70*b*) of the shorter primary stirrers (66*b*) are shown directed radially outwards with respect to the central shaft.

The aforementioned "piling up" action can be minimized by the design shown in FIGS. 7, 8, and 9.

Figure 10:
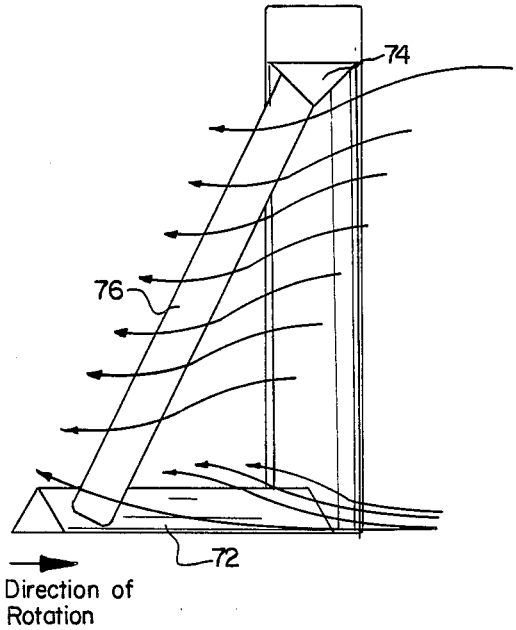
FIG. 10 is a schematic diagram showing the action of the stirrers on the milling media in an apparatus in which the top and bottom stirrers are non-coplanar.

FIG. 10 is a schematic diagram showing the action of the stirrers on the milling media in an apparatus in which the upper and bottom stirrers are non-coplanar. The upper stirrer (74) pushes down on the media helping to maintain a high density state. The bottom stirrer (72) lifts the media from the bottom of the mill helping to make milling more uniform and reducing media breakage. The media is vigorously stirred by primary stirrers (76), but it does not pile up in front of them as they sweep through the media. In fact, the media is forced downwards and outwards by these members, thus increasing the circulation of the mill while maintainining a high packing density state within the bed of the media.

While there has been shown and described what are at present considered the preferred embodiments of the invention, it will be obvious to those skilled in the art that various changes and modifications may be made therein without departing from the scope of the invention as defined by the appended claims.

What is claimed is:

1. An apparatus for milling metal powder in a stirred media mill, said apparatus comprising a central shaft the top of which is rotatably mounted to rotating means, first and second bottom stirrers, first and second upper stirrers, said bottom stirrers attached to the bottom end of said central shaft, said upper stirrers attached to said central shaft at a point above the point of attachment of the bottom stirrers, each of said bottom stirrers having a downward sloping leading edge, with a first angle of from about 10° to about 90° formed by a first plane extending along said downward sloping leading edge to a second plane extending along the bottom of said mill and said second plane, with said first angle being that angle which is between the faces of said first and second planes within which said bottom stirrers sit, and each of said bottom stirrers having a bottom edge with the distance between the bottom of said mill and the lowest point of said downward sloping leading edge being equal to or less than the distance between the bottom of said mill and any other point on said bottom edges of said bottom stirrers, each of said upper stirrers having an upward sloping leading edge with a second angle of from about 10° to about 90° formed by a third plane extending along said upward sloping leading edge to a fourth plane parallel to the top of said mill and above said upper stirrers and said fourth plane, with said second angle being that angle which is between the faces of said third and fourth planes within which said upper stirrers sit, and each of said upper stirrers having a top edge with the distance between said fourth plane and the uppermost point of said upward sloping leading edge being equal to or less than the distance between said fourth plane and any other point on said top edges of said upper stirrers, and pairs of primary stirrers having their top ends attached to each outer edge of said upper stirrers and their bottom ends attached to each outer edge of said bottom stirrers, with said first upper stirrer and said first bottom stirrer having a length which allows them to be in close proximity to the lateral edges of said mill, and said second upper stirrer and said second lower stirrer having a length which is less than the length of said first upper stirrer and said first bottom stirrer respectively.

2. An apparatus of claim 1 wherein said upper and bottom stirrers are coplanar.

3. An apparatus of claim 2 wherein said primary stirrers are in the shape of triangular prisms having their apex edges directed radially inward with respect to the central shaft when said upper and bottom stirrers are in close proximity to the lateral edges of said mill.

4. An apparatus of claim 2 wherein said primary stirrers are in the shape of triangular prisms having their apex edges directed radially outward with respect to the central shaft and the length of the upper and bottom stirrers to which said primary stirrers are attached is less than about one-half the radius of a circle formed by the rotation of the longer upper and bottom stirrers.

5. An apparatus of claim 1 wherein said upper and bottom stirrers are not coplanar.

6. An apparatus of claim 5 wherein there are four primary stirrers.

7. An apparatus of claim 5 wherein said primary stirrers are in the shape of triangular prisms having their apex edges directed radially inward with respect to the central shaft when said upper and bottom stirrers are in close proximity to the lateral edges of said mill.

8. An apparatus of claim 5 wherein said primary stirrers are in the shape of triangular prisms having their apex edges directed radially outward with respect to the central shaft and the length of the upper and bottom stirrers to which said primary stirrers are attached is less than about one-half the radius of a circle formed by the rotation of the longer upper and bottom stirrers.

* * * * *